US007753803B2

(12) United States Patent
Chang

(10) Patent No.: US 7,753,803 B2
(45) Date of Patent: Jul. 13, 2010

(54) SHAFT OF BILLIARD CUE

(76) Inventor: Jung-Shih Chang, No. 32, Lane 25, Li Min Street, Ta Li City, Taichung Hsien (TW)

( * ) Notice: Subject to any disclaimer, the term of this patent is extended or adjusted under 35 U.S.C. 154(b) by 0 days.

(21) Appl. No.: 12/352,190

(22) Filed: Jan. 12, 2009

(65) Prior Publication Data

US 2010/0093455 A1 Apr. 15, 2010

(30) Foreign Application Priority Data

Oct. 14, 2008 (CN) ..... 2008 1 0166654

(51) Int. Cl.
*A63D 15/08* (2006.01)

(52) U.S. Cl. ..... 473/44

(58) Field of Classification Search ..... 473/44–51
See application file for complete search history.

(56) References Cited

U.S. PATENT DOCUMENTS 4,231,574 A * 11/1980 Williams ..... 473/44
6,162,128 A * 12/2000 McCarty et al. ..... 473/49
2002/0132677 A1* 9/2002 Chang ..... 473/44
2006/0205525 A1* 9/2006 Owen ..... 473/44
2007/0123362 A1* 5/2007 Marino ..... 473/44
2008/0132346 A1* 6/2008 Costain et al. ..... 473/44

* cited by examiner

*Primary Examiner*—Mark S Graham
(74) *Attorney, Agent, or Firm*—Browdy and Neimark, PLLC

(57) ABSTRACT

A shaft of a billiard cue includes a first section and a second section connected to the first section. The first section is made of natural wood and has a front end to be a top end of the shaft and a rear connecting end to connect to the second section. The second section is not made of natural wood but of a material with a hardness being greater than that of the first section. The second section has a front connecting end to connect with the rear connecting end of the first section and a rear end to be a bottom end of the shaft.

11 Claims, 4 Drawing Sheets

SHAFT OF BILLIARD CUE

BACKGROUND OF THE INVENTION

1. Field of the Invention

The present invention relates generally to a billiard cue and more particularly to a shaft of a billiard cue.

2. Description of the Related Art

It is well known that a conventional billiard cue is generally comprised of a shaft and a butt, which is connected to the shaft by a joint. For better control and feel when striking a cue ball, the shaft of a billiard cue must possess certain properties such as suitable elasticity and stiffness. A shaft made of certain types of natural wood has such properties. Experience has established that to achieve suitable elasticity and stiffness to be a shaft of a billiard cue, the natural wood must be of adequate length with the grain thereof extending in a unilateral direction and the density thereof distributing uniformly. In this day and age, such natural wood is difficult to find and thereby expensive.

Thus, it would be desirable to provide a shaft of a billiard cue that is low in cost but still possesses the necessary properties of natural wood.

SUMMARY OF THE INVENTION

To achieve the desired effect mentioned above, the present invention discloses a shaft of a billiard cue which comprises a first section and a second section connected to the first section. The first section is made of natural wood and has a front end to be a top end of the shaft and a rear connecting end to connect to the second section. The second section is not made of natural wood but of a material with a hardness being greater than that of the first section. The second section has a front connecting end to connect with the rear connecting end of the first section and a rear end to be a bottom end of the shaft.

BRIEF DESCRIPTION OF THE DRAWINGS

The various features, advantages and other uses of the present invention will become more apparent by referring to the following detailed descriptions and drawings in which.

DETAILED DESCRIPTION OF THE INVENTION

Figure 1:
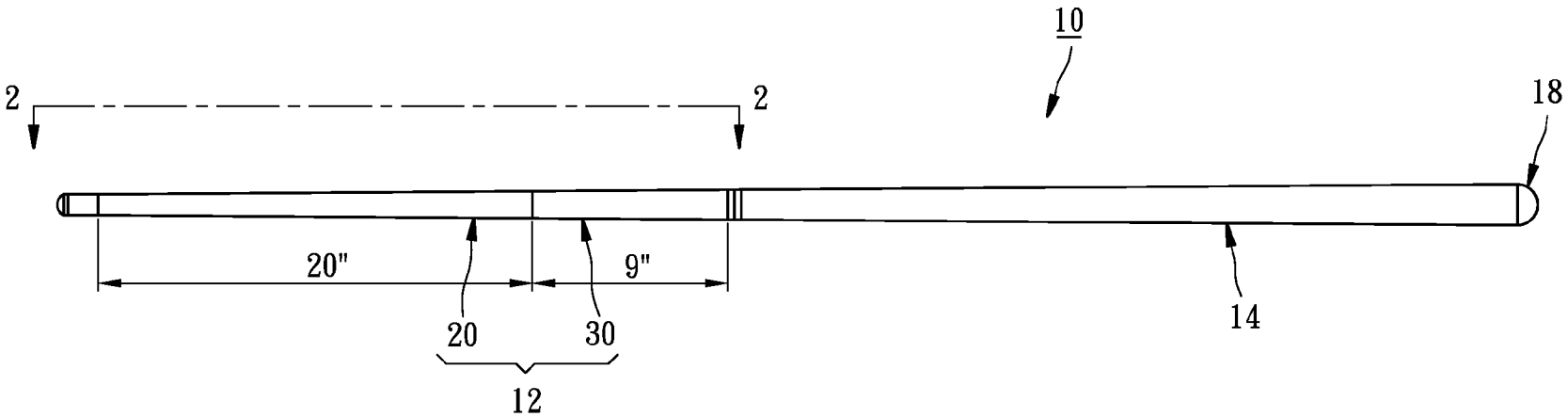
FIG. 1 is a side view of a first preferred embodiment of a shaft of a billiard cue according to the present invention.
Figure 2:
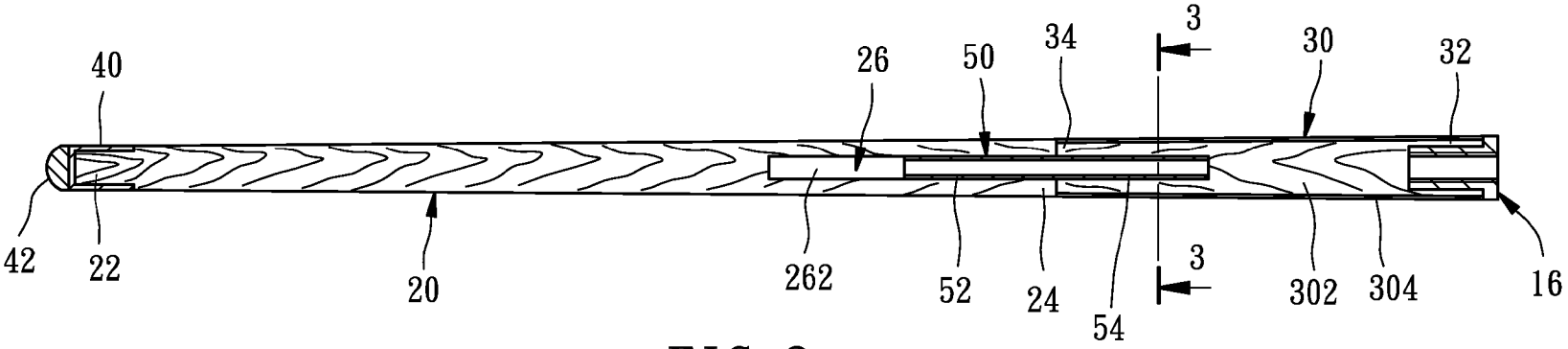
FIG. 2 is a cross sectional view taken along line 2-2 in FIG. 1.
Figure 3:
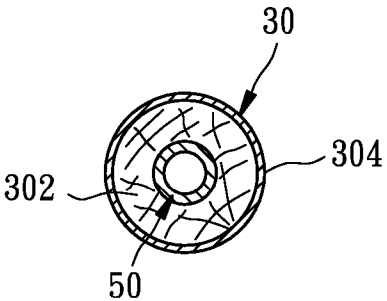
FIG. 3 is a cross sectional view taken along line 3-3 in FIG. 2.

Referring firstly to FIGS. 1-3, a billiard cue 10 includes a shaft 12 and a butt 14. In this embodiment, shaft 12 is connected to butt 14 by a joint 16. Butt 14 has a rear end coupled with a pad 18.

Shaft 12 is designed to have a first section 20 and a second section 30. First section 20 is made of a natural wood, such as maple, with a grain thereof extending along the axis of billiard cue 10. First section 20 substantially has a length that is at least 60% of the whole length of shaft 12. In this embodiment, shaft 12 is tapered with a total length of 29 inches, first section 20 is 20 inches in length, and second section 30 is 9 inches in length. First section 20 has a front end 22 and a rear connecting end 24. Front end 22 is to be a distal end of billiard cue 10 and engaged therewith a ferrule 40. A tip 42 is mounted on a top end of ferrule 40.

Second section 30 is made of a material the hardness of which is greater than that of first section 20, such as metal, fiber reinforced plastic materials ("FRP"), natural wood having a hardness greater than that of first section 20, or wood laminate material consisting of a plurality of wood strips. In the embodiment, second section 30 is made of a material having a laminated wooden core 302 wrapped with an FRP layer 304. Second section 30 has a rear end 32 to be a bottom end of shaft 12 and a front connecting end 34 to connect to rear connecting end 24 of first section 20.

There are many prior art ways to connect first section 20 with second section 30. In this embodiment, a connecting tube 50 made of FRP is used to connect first section 20 with second section 30. Connecting tube 50 is about 15 inches in length and has a front body 52 and a rear body 54. In connecting, front body 52 is inserted into first section 20 from rear connecting end 24 thereof. Rear body 54 is inserted into second section 30 from front connecting end 34.

Furthermore, there is another important aspect in the present invention. Specifically shown in FIG. 2, first section 20 has a receiving bore 26 extending along the axis of shaft 12 from rear connecting end 24 of first section 20 to the body thereof to receive front body 52 of connecting tube 50. The length of bore 26 is longer than that of front body 52 so that a hollow portion 262 is formed when front body 52 is inserted into bore 26. Such a design is used to increase the elasticity of first section 20.

Figure 4:
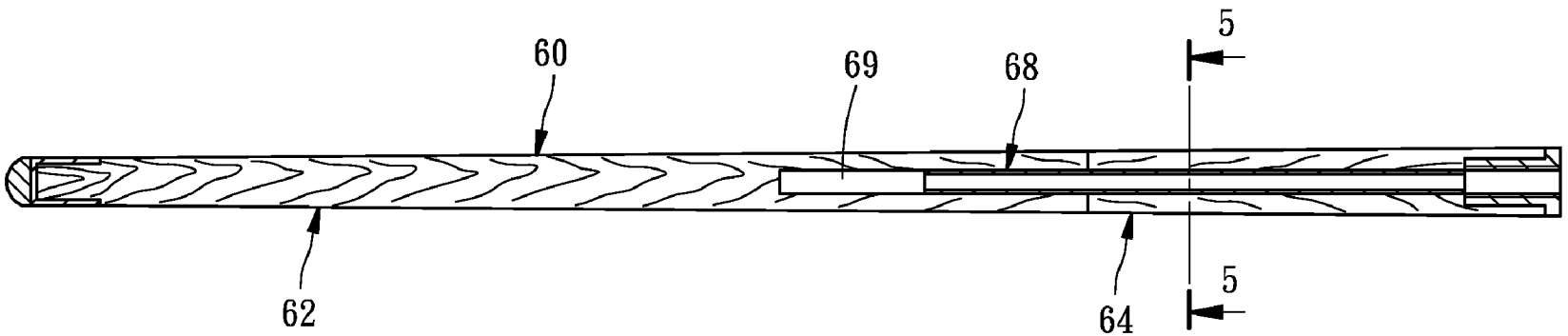
FIG. 4 is similar to FIG. 2 but shows a cross sectional view of a second preferred embodiment of a shaft of a billiard cue according to the present invention.
Figure 5:
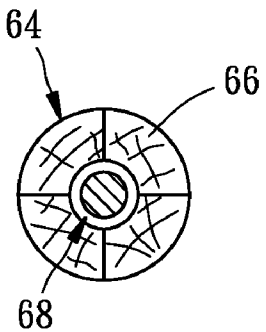
FIG. 5 is a cross sectional view taken along line 5-5 in FIG. 4.

Referring secondly to FIG. 4 and FIG. 5, a shaft 60 of a second embodiment according to the present invention has a first section 62 and a second section 64. The difference between the first and second embodiments is that second section 64 is made of four elongated wood strips 66 laminated together. An FRP long tube 68 is embedded in the core of second section 64 and a front part thereof is inserted into a bore 69 of first section 62.

Figure 6:
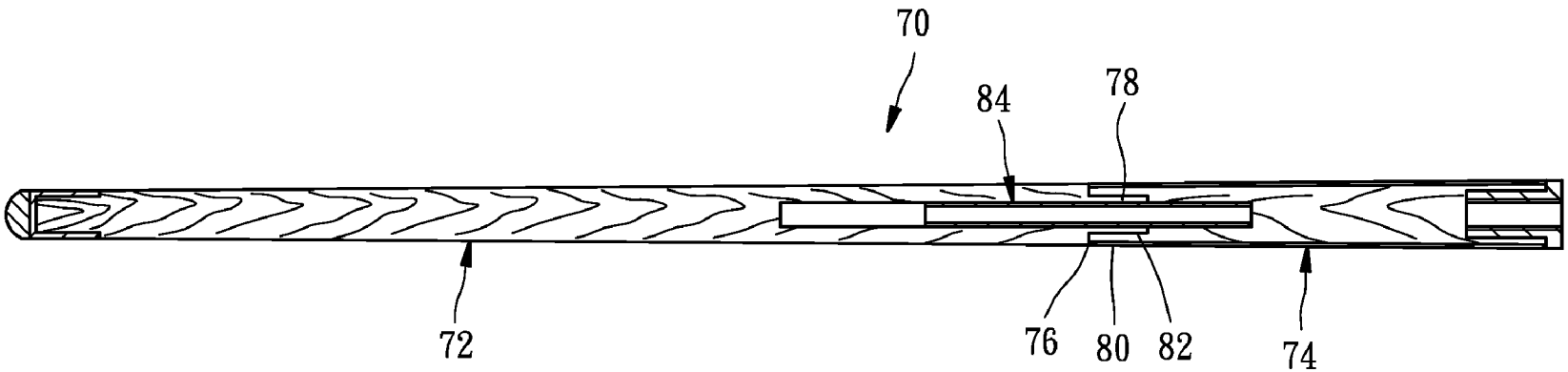
FIG. 6 is similar to FIG. 2 but shows a cross sectional view of a third preferred embodiment of a shaft of a billiard cue according to the present invention.

Referring lastly to FIG. 6, a shaft 70 of a third embodiment of the present invention is similar to shaft 20 of the first embodiment. The difference between the first and third embodiments is the way by which the two sections of shaft 70 are connected. Shaft 70 has a first section 72 and a second section 74. First section 72 has a rear connecting end 76 with a male tenon 78. Second section 74 has a front connecting end 80 with a female tenon 82. In construction, male tenon 78 is inserted into female tenon 82 so that first section 72 is tenoned to second section 74.

As described above, in the present invention, only the most important portion of a shaft, i.e. the first section, is made of natural wood. Because the length of the first section is shorter than that of the shaft, the amount of natural wood required is reduced, thereby reducing the production cost. In addition, the shaft of the present invention has a second section the hardness of which is greater than that of the first section so that the force a player applies to a billiard cue when striking a cue ball is quickly transmitted to and concentrated in the striking point.

What is claimed is:

1. A shaft of a billiard cue, comprising:

a first section made of natural wood and having a front end to be a top end of said shaft, and a rear connecting end;

a second section made of a material with a hardness being greater than that of said first section, said second section having a front connecting end to connect with said rear connecting end of said first section and a rear end to be a bottom end of said shaft; and a connecting device having a front body and a rear body, said front body being axially inserted into said rear connecting end of said first section, and said rear body being axially inserted into said front connecting end of said second section.

2. The shaft as defined in claim 1, wherein said first section has a length being at least 60% of the whole length of said shaft.

3. The shaft as defined in claim 1, wherein the grain of the natural wood to make said first section extends along the axis of said shaft.

4. The shaft as defined in claim 1, wherein said second section is made of metal.

5. The shaft as defined in claim 1, wherein said second section is made of fiber reinforced plastic materials.

6. The shaft as defined in claim 1, wherein said first section has a receiving bore extending along the axis of said shaft from said rear connecting end to the body of said first section to receive said front body of said connecting device.

7. The shaft as defined in claim 6, wherein the length of said bore is longer than that of said front body of said connecting device so that a hollow portion is formed when said front body is inserted into said bore.

8. The shaft as defined in claim 1, wherein said connecting device is made of fiber reinforced plastic materials.

9. The shaft as defined in claim 1, wherein the length of said first section is longer than that of said second section.

10. The shaft as defined in claim 9, wherein the length of said first section is 20 inches and the length of said second section is 9 inches.

11. The shaft as defined in claim 1, wherein said rear connecting end of said first section is tenoned to said front connecting end of said second section.

* * * * *